US007834609B2

(12) United States Patent
Irmscher

(10) Patent No.: US 7,834,609 B2
(45) Date of Patent: Nov. 16, 2010

(54) SEMICONDUCTOR DEVICE WITH COMPENSATION CURRENT

(75) Inventor: Stefan Irmscher, Sollentuna (SE)

(73) Assignee: Infineon Technologies AG, Neubiberg (DE)

( * ) Notice: Subject to any disclaimer, the term of this patent is extended or adjusted under 35 U.S.C. 154(b) by 559 days.

(21) Appl. No.: 11/847,856

(22) Filed: Aug. 30, 2007

(65) Prior Publication Data

US 2009/0058390 A1 Mar. 5, 2009

(51) Int. Cl.
*G05F 3/16* (2006.01)
*G05F 3/24* (2006.01)

(52) U.S. Cl. ..... 323/312; 327/543

(58) Field of Classification Search ..... 323/312–314, 323/311; 327/538–539, 543
See application file for complete search history.

(56) References Cited

U.S. PATENT DOCUMENTS 5,430,367 A * 7/1995 Whitlock et al. ..... 323/313
5,581,174 A * 12/1996 Fronen ..... 323/316
5,926,062 A * 7/1999 Kuroda ..... 327/538
6,650,151 B2 11/2003 Yazdy et al.
7,078,958 B2 * 7/2006 Gower et al. ..... 327/539
7,154,325 B2 12/2006 La Rosa

* cited by examiner

*Primary Examiner*—Harry Behm
(74) *Attorney, Agent, or Firm*—Dicke, Billig & Czaja, P.L.L.C.

(57) ABSTRACT

A semiconductor device is disclosed. In one embodiment, the semiconductor device includes a first resistor, a second resistor, and a transistor. The second resistor is configured to receive a current via the first resistor. The transistor is configured to be driven via the first resistor and the second resistor and provide a compensation current. The current includes the compensation current and a reference current and changes in the current are compensated for via the compensation current which limits changes in the reference current.

25 Claims, 9 Drawing Sheets

SEMICONDUCTOR DEVICE WITH COMPENSATION CURRENT

BACKGROUND

Often, semiconductor devices include one or more reference voltage sources and/or one or more reference current sources. The semiconductor devices can be analog circuits, digital circuits, or mixed signal analog and digital circuits. Each of the semiconductor devices can be a single integrated circuit chip or multiple integrated circuit chips. Reference voltage sources and reference current sources are two of the major building blocks of analog circuits, such as radio frequency (RF) circuits.

Sometimes, reference voltage sources and reference current sources include a bandgap reference circuit that includes two diodes running at different current densities. The voltage difference between the two diodes is used to generate a proportional to absolute temperature (PTAT) current in a first resistor. The PTAT current is used to generate a voltage in a second resistor, which is added to the voltage of one of the diodes or a third diode. The voltage across a diode operated at a constant current or at the PTAT current is complementary to absolute temperature (CTAT), i.e., reduces with increasing temperature at approximately −2 mV/K. If the ratio between the first and second resistor is chosen properly, the first order effects of the CTAT dependency of the diode and the PTAT current cancel and the resulting voltage is about 1.2-1.3 V, which is close to the theoretical bandgap of silicon at 0 K. The voltage change over operating temperature is on the order of a few millivolts and has a parabolic behavior.

Typically, one or more reference currents are generated in an analog circuit. The reference currents can be generated via a bandgap reference and one or more resistors. The bandgap reference voltage can be maintained across the resistors to provide the reference current. Resistance values of the resistors are subject to process variations, such as doping levels in the silicon, which results in changes in the reference current. The changes in the reference current due to process variations can be more than three times the changes in bandgap voltage due to process variations.

For these and other reasons there is a need for the present invention.

BRIEF DESCRIPTION OF THE DRAWINGS

The accompanying drawings are included to provide a further understanding of the present invention and are incorporated in and constitute a part of this specification. The drawings illustrate the embodiments of the present invention and together with the description serve to explain the principles of the invention. Other embodiments of the present invention and many of the intended advantages of the present invention will be readily appreciated as they become better understood by reference to the following detailed description. The elements of the drawings are not necessarily to scale relative to each other. Like reference numerals designate corresponding similar parts.

DETAILED DESCRIPTION

In the following Detailed Description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
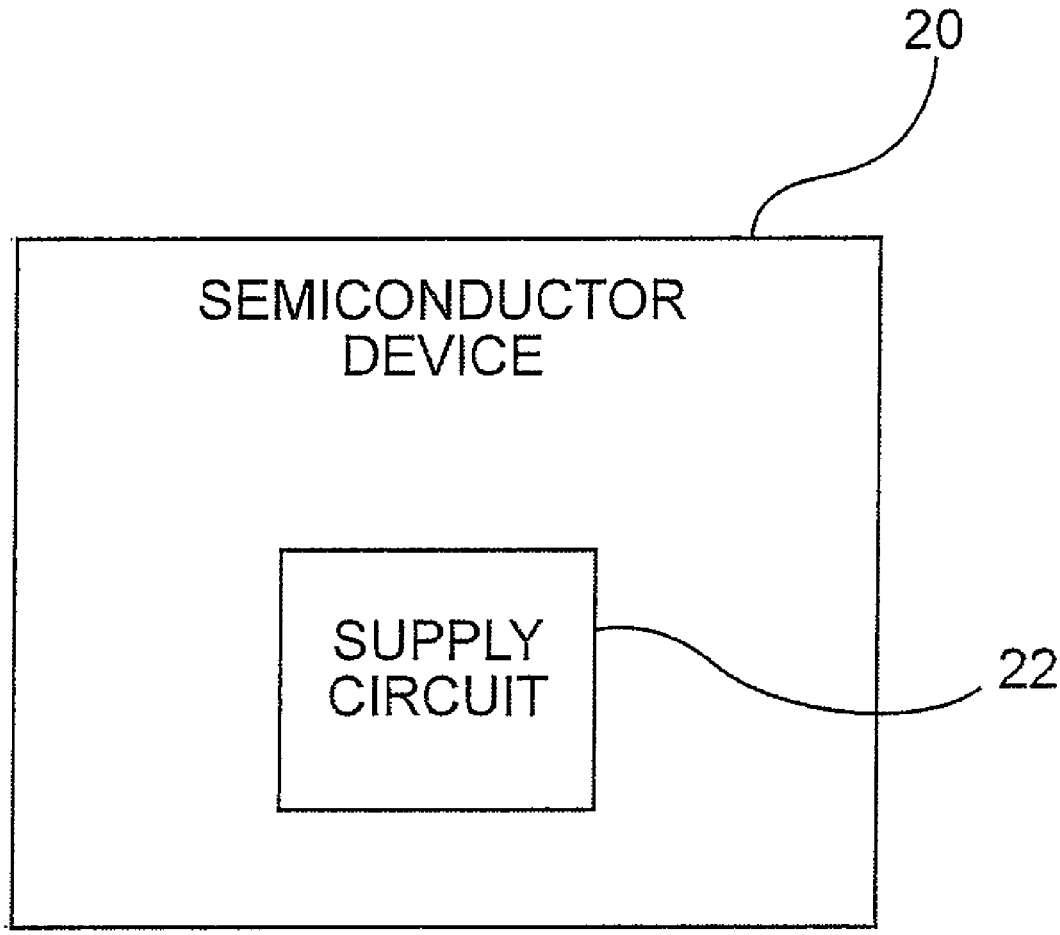
FIG. 1 is a diagram illustrating one embodiment of a semiconductor device.

FIG. 1 is a diagram illustrating one embodiment of a semiconductor device 20 according to the present invention. Semiconductor device 20 includes a supply circuit 22. In one embodiment, semiconductor device 20 is a single integrated circuit chip. In one embodiment, semiconductor device 20 includes multiple integrated circuit chips. In one embodiment, semiconductor device 20 is an analog circuit. In one embodiment, semiconductor device 20 is a digital circuit. In one embodiment, semiconductor device 20 is a mixed signal analog and digital circuit.

Supply circuit 22 provides a reference parameter in semiconductor device 20. Each of the integrated circuit chips that include a supply circuit, such as supply circuit 22, can have different process parameter values. Supply circuit 22 provides a reference value that is stabilized over variations in the process parameters. In one embodiment, supply circuit 22 is a reference voltage source that provides a stabilized reference voltage in semiconductor device 20. In one embodiment, supply circuit 22 is a reference current source that provides a stabilized reference current in semiconductor device 20.

Supply circuit 22 includes series coupled resistors that receive a current. The voltage across the resistors is maintained at a substantially constant reference voltage. The current received by the resistors includes a reference current and compensation current. In one embodiment, the resistors are polysilicon resistors.

Resistance values of the resistors change based on variations in the process parameters. Changes in the resistance values result in changes in the magnitude of the current received by the resistors. If the resistance values decrease, the current increases and the compensation current increases. If the resistance values increase, the current decreases and the compensation current decreases. The compensation current compensates for the changes in the current and limits changes in the reference current. In one embodiment, the reference current is mirrored to provide a mirrored reference current.

In one embodiment, the resistors are polysilicon resistors and the resistance values of the resistors change substantially plus or minus 9% due to process variations. This results in a current change of substantially plus or minus 9% based on the changes in the resistance values of the resistors. The compensation current changes to compensate for the changes in the current and the reference current is limited to changes of substantially plus or minus 4%.

In one embodiment, supply circuit 22 includes a reference voltage and the voltage across the resistors is a buffered reference voltage maintained at substantially the value of the reference voltage. In one embodiment, supply circuit 22 includes a reference voltage and the voltage across the resistors is a buffered reference voltage maintained at a voltage value corresponding to the reference voltage. In one embodiment, supply circuit 22 includes a bandgap voltage and the voltage across the resistors is a buffered bandgap voltage maintained at substantially the bandgap voltage. In one embodiment, supply circuit 22 includes a bandgap voltage and the voltage across the resistors is a buffered bandgap voltage maintained at a voltage value corresponding to the bandgap voltage.

Figure 2:
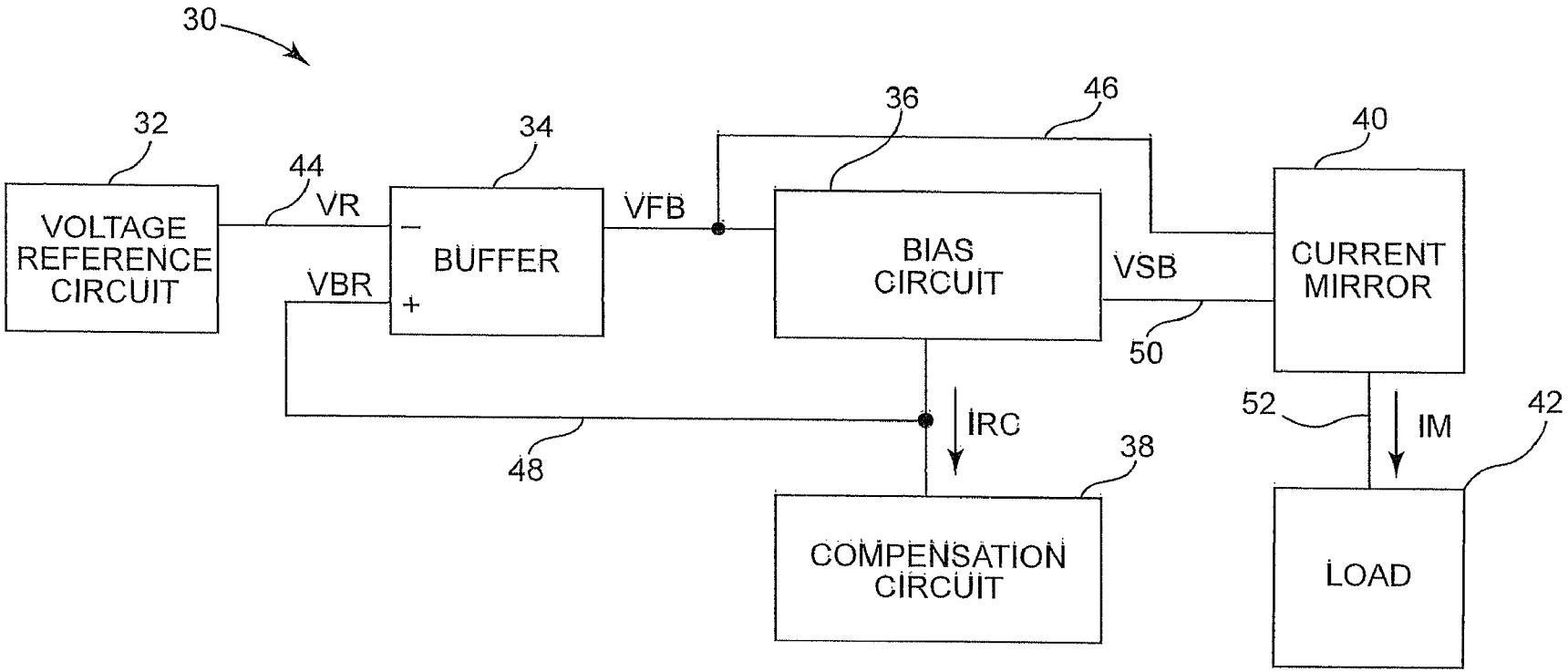
FIG. 2 is a block diagram illustrating one embodiment of a supply circuit.

FIG. 2 is a block diagram illustrating one embodiment of a supply circuit 30 that provides a reference current IRC and a mirrored reference current IM. The reference current IRC is stabilized over variations in process parameters and the mirrored reference current PA mirrors the stabilized reference current IRC. Supply circuit 30 is similar to supply circuit 22 (shown in FIG. 1).

Supply circuit 30 includes a voltage reference circuit 32, a buffer 34, a bias circuit 36, a compensation circuit 38, a current mirror 40, and a load 42. Voltage reference circuit 32 is electrically coupled to one input of buffer 34 via reference voltage path 44. Buffer 34 is electrically coupled to bias circuit 36 and current mirror 40 via first bias signal path 46. Buffer 34 is also electrically coupled to bias circuit 36 and compensation circuit 38 via buffered reference voltage path 48. Bias circuit 36 is electrically coupled to compensation circuit 38 via buffered reference voltage path 48 and to current mirror 40 via second bias signal path 50. Current mirror 40 is electrically coupled to load 42 via load path 52.

Voltage reference circuit 32 provides a reference voltage VR via reference voltage path 44. Reference voltage VR at 44 is substantially constant and stabilized over the operating temperature of supply circuit 30. In addition, reference voltage VR at 44 is stabilized over process variations. In one embodiment, reference voltage VR at 44 is stabilized over process variations to plus 3.3% and minus 2% or about plus or minus 2.5%.

In one embodiment, voltage reference circuit 32 is a bandgap reference circuit that provides a bandgap reference voltage VR at 44. Bandgap reference voltage VR at 44 is a temperature stabilized constant voltage that is substantially equal to the bandgap voltage of silicon or about 1.2 volts. In addition, the bandgap reference voltage VR at 44 is stabilized over process variations to plus 3.3% and minus 2% or about plus or minus 2.5%.

The negative input of buffer 34 receives-reference voltage VR at 44 and the positive input of buffer 34 receives buffered reference voltage VBR via buffered reference voltage path 48. The negative input of buffer 34 is a high impedance input that does not adversely load voltage reference circuit 32. The positive input of buffer 34 is a high impedance input that draws only a little leakage current or no current from bias circuit 36. Buffer 34 provides first bias voltage VFB to bias circuit 36 via output path 46. First bias voltage VFB at 46 is based on a comparison of reference voltage VR at 44 and buffered reference voltage VBR at 48. In one embodiment, buffer 34 includes an operational amplifier that compares reference voltage VR at 44 and buffered reference voltage VBR at 48 and provides first bias voltage VFB at 46.

Bias circuit 36 receives first bias voltage VFB at 46 and provides second bias voltage VSB at 50. Bias circuit 36 provides reference current IRC at 48 based on the voltage values of first bias voltage VFB at 46 and second bias voltage VSB at 50. In one embodiment, bias circuit 36 includes p-channel metal oxide semiconductor (PMOS) transistors biased to conduct more or less current based on the voltage values of first bias voltage VFB at 46 and second bias voltage VSB at 50. In one embodiment, bias circuit 36 includes a current mirror that provides a current, similar to reference current IRC at 48, through one or more resistors to provide second bias voltage VSB at 50.

Compensation circuit 38 receives reference current IRC at 48. Buffered reference voltage VBR at 48 is obtained via compensation circuit 38 and reference current IRC at 48. Buffered reference voltage VBR at 48 is fed back to buffer 34 and compared to reference voltage VR at 44. Buffer 34 provides first bias voltage VFB at 46 to bias circuit 36, which provides reference current IRC at 48. Buffered reference voltage VBR at 48 corresponds to reference voltage VR at 44. In one embodiment, buffered reference voltage VBR at 48 is maintained at substantially reference voltage VR at 44.

In one embodiment, compensation circuit 38 includes series coupled resistors and a transistor. The series coupled resistors receive a total current that includes reference current IRC at 48 and a compensation current provided via the transistor. The voltage across the resistors is buffered reference voltage VBR at 48. Resistance-values of the resistors change based on variations in the process parameters, and the magnitude of the total current changes to maintain buffered reference voltage VBR at 48 at substantially reference voltage VR at 44. If the resistance values decrease due to process variations, the total current increases. In addition, the compensation current increases due to the process variations. If the resistance values increase due to the process variations, the total current decreases and the compensation current decreases due to the process variations. The compensation current compensates for changes in the total current, which limits changes in the reference current IRC at 48. In one embodiment, the resistors are polysilicon resistors.

Current mirror 40 receives first bias voltage VFB at 46 and second bias voltage VSB at 50 and provides a mirrored reference current IM at 52. Load 42 receives mirrored reference current IM at 52. In one embodiment, mirrored reference current IM at 52 is substantially the same value as reference current IRC at 48. In one embodiment, load 42 is a polysilicon resistor.

Figure 3:
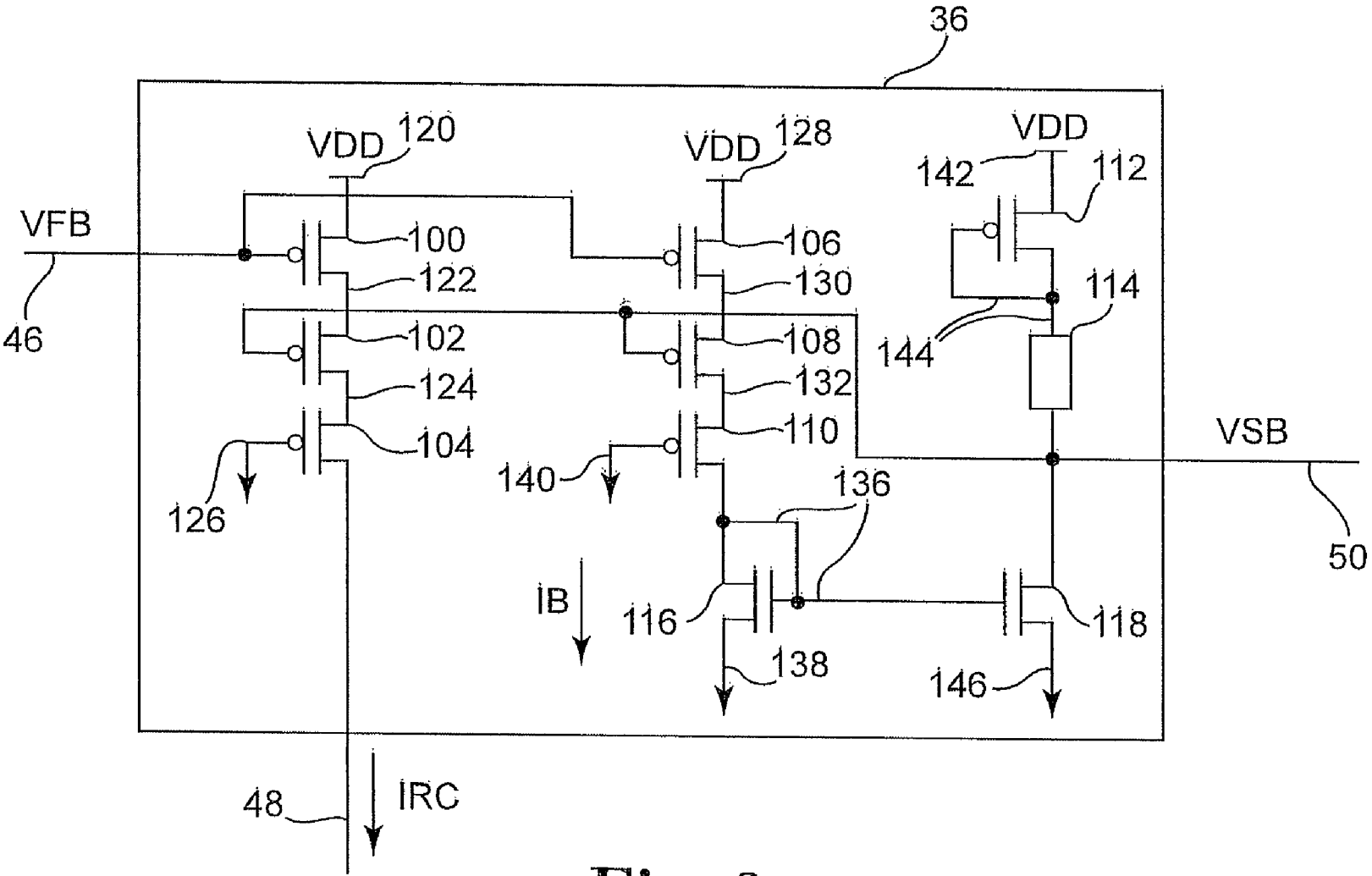
FIG. 3 is a diagram illustrating one embodiment of a bias circuit.

FIG. 3 is a diagram illustrating one embodiment of bias circuit 36 that receives first bias voltage VFB at 46 and generates second bias voltage VSB at 50. Bias circuit 36 provides reference current IRC at 48 based on the voltage values of first bias voltage VFB at 46 and second bias voltage VSB at 50.

Bias circuit 36 includes a first PMOS transistor 100, a second PMOS transistor 102, a third PMOS transistor 104, a fourth PMOS transistor 106, a fifth PMOS transistor 108, a sixth PMOS transistor 110, and a seventh PMOS transistor 112. Bias circuit 36 also includes a resistor 114, a first n-channel metal oxide semiconductor (NMOS) transistor 116, and a second NMOS transistor 118.

The gate of first PMOS transistor 100 receives first bias voltage VFB at 46 and one side of the drain-source path of first PMOS transistor 100 is electrically coupled to VDD at 120. The other side of the drain-source path of first PMOS transistor 100 is electrically coupled at 122 to one side of the drain-source path of second PMOS transistor 102. The other side of the drain-source path of second PMOS transistor 102 is electrically coupled at 124 to one side of the drain-source path of third PMOS transistor 104. The other side of the drain-source path of third PMOS transistor 104 is electrically coupled to the positive input of buffer 34 and compensation circuit 38 via buffered reference-voltage path 48. The gate of second PMOS transistor 102 receives second bias voltage VSB at 50 and the gate of third PMOS transistor 104 receives a reference voltage, such as ground, at 126.

The gate of fourth PMOS transistor 106 receives first bias voltage VFB at 46. One-side of the drain-source path of fourth PMOS transistor 106 is electrically coupled to VDD at 128. The other side of the drain-source path of fourth PMOS transistor 106 is electrically coupled at 130 to one side of the drain-source path of fifth PMOS transistor 108. The other side of the drain source path of fifth PMOS transistor 108 is electrically coupled at 132 to one side of the drain-source path of sixth PMOS transistor 110. The other side of the drain-source path of sixth PMOS transistor 110 is electrically coupled at 136 to the gate and one side of the drain-source path of first NMOS transistor 116 and the gate of second NMOS transistor 118. The other side of the drain-source path of first NMOS transistor 116 is electrically coupled to a reference, such as ground, at 138. The gate of fifth PMOS transistor 108 receives second bias voltage VSB at 50 and the gate of sixth PMOS transistor 110 receives a reference voltage, such as ground, at 140.

Seventh PMOS transistor 112 is diode connected to operate as a resistor. One side of the drain-source path is electrically coupled to VDD at 142. The gate and the other side of the drain-source path of seventh PMOS transistor 112 are electrically coupled at 144 to one end of resistor 114. The other end of resistor 114 is electrically coupled to one side of the drain-source path of second NMOS transistor 118 via second bias signal path 50. The other side of the drain-source of second NMOS transistor 118 is electrically coupled to a reference, such as ground, at 146.

In operation, the gates of first PMOS transistor 100 and fourth PMOS transistor 106 receive first bias voltage VFB at 46. The gates of second PMOS transistor 102 and fifth PMOS transistor 108 receive second bias voltage VSB at 50. The gate of third PMOS transistor 104 receives the reference voltage at 126 and the gate of sixth PMOS transistor 110 receives the reference voltage at 140, where the reference voltage at 126 is substantially equal to the reference voltage at 140.

Reference current IRC at 48 is provided via first PMOS transistor 100, second PMOS transistor 102, and third PMOS-transistor 104. First PMOS transistor 100 is biased to conduct current via first bias voltage VFB at 48, second PMOS transistor 102 is biased to conduct current via second bias voltage VSB at 50, and third PMOS transistor 104 is biased to conduct current via the reference voltage at 126. Bias current IB is provided via fourth PMOS transistor 106, fifth PMOS transistor 108, and sixth PMOS transistor 110. Fourth PMOS-transistor 106 is biased to conduct current via first bias voltage VFB at 48, fifth PMOS transistor 108 is biased to conduct current via second bias voltage VSB at 50, and sixth PMOS transistor 104 is biased to conduct current via the reference voltage at 140.

The conducting PMOS transistors 100, 102, and 104 provide reference current IRC at 48 and the conducting PMOS transistors 106, 108, and 110 provide bias current IB to first NMOS transistor 116. Bias current IB has substantially the same value as reference current IRC at 48. Bias current IB is mirrored via second NMOS transistor 118 and provided through seventh PMOS transistor 112 and resistor 114. The voltage drop across seventh PMOS transistor 112 and resistor 114 is subtracted from VDD at 142 to provide second bias voltage VSB at 50.

Figure 4:
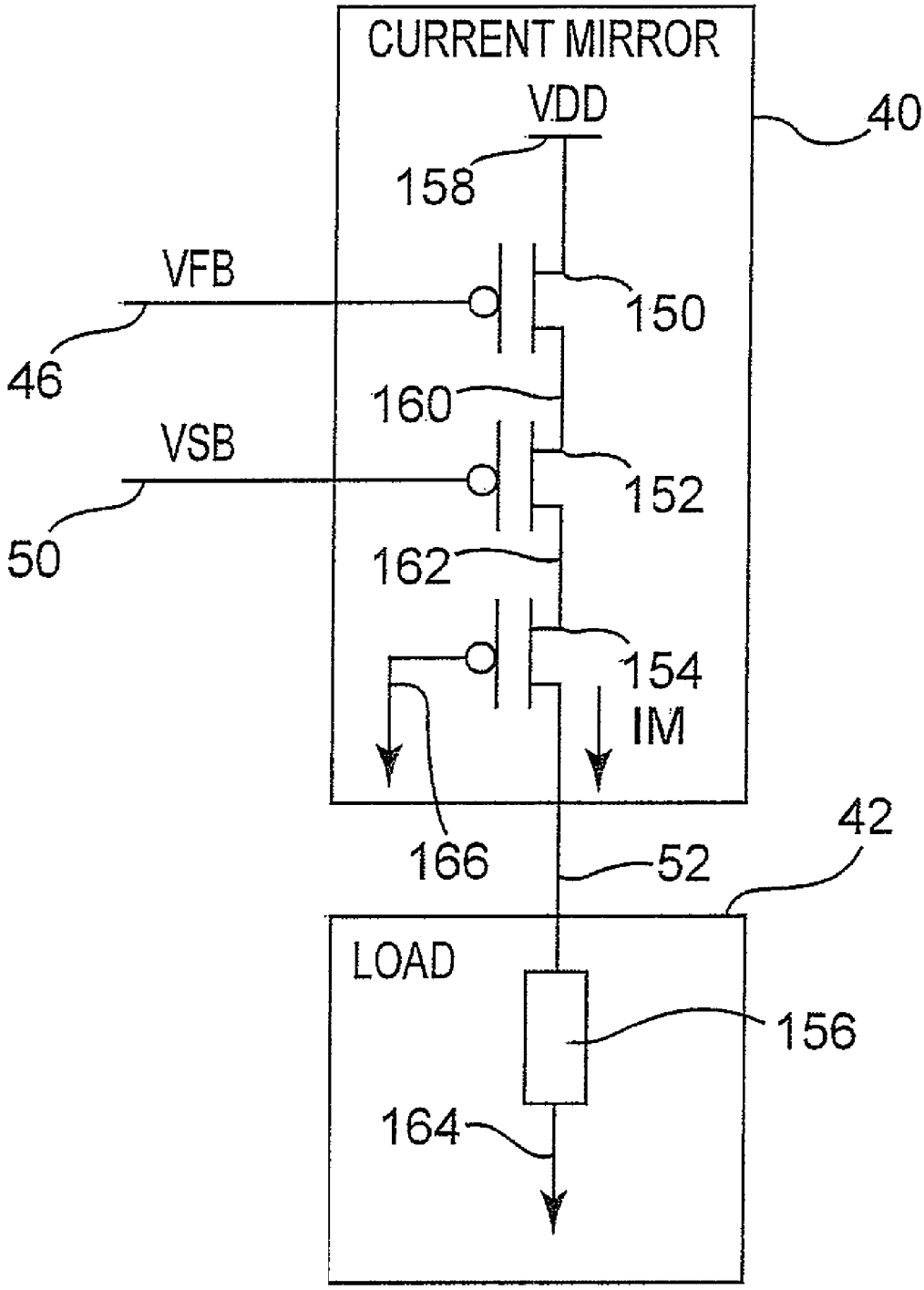
FIG. 4 is a diagram illustrating one embodiment of a current mirror and load.

Compensation circuit 38 (shown in FIG. 2) receives reference current IRC at 48 and provides buffered reference voltage VBR at 48. Buffer 34 compares reference voltage VR at 44 and buffered reference voltage VBR at 48 and provides first bias voltage VFB at 46. First bias voltage VFB at 46 biases first PMOS transistor 100 and fourth PMOS transistor 106 to conduct more or less current, which changes reference current IRC at 48 and bias current IB. The change in bias current IB adjusts the voltage drop across seventh PMOS transistor 112 and resistor 114, which changes-second bias voltage VSB at 50. Second bias voltage VSB at 50 biases second PMOS transistor 102 and fifth PMOS transistor 108 to conduct more or less current, which changes reference current IRC at 48 and bias current IB. The changes in reference current IRC at 48 and bias current IB changes first bias voltage VFB at 46 and second bias voltage VSB at 50. The process continues until-reference current IRC at 48 stabilizes at a constant reference voltage. The first bias voltage VFB at 46 and second bias voltage VSB at 50 are provided to current mirror 40. In one embodiment, resistor 114 is a polysilicon resistor. In one embodiment, bias-circuit 36 includes start up circuitry that provides a clean start at power up FIG. 4 is a diagram illustrating one embodiment of current mirror 40 and load 42. Current mirror 40 receives first bias voltage VFB at 46 and second bias voltage VSB at 50. Current mirror 40 provides mirrored reference current. IM at 252 based on the voltage values of first bias voltage VFB at 46 and second bias voltage VSB at 50. Mirrored reference current IM at 52 has substantially the same current value as reference current IRC at 48.

Current mirror 40 includes a first current mirror PMOS transistor 150, a second current mirror PMOS transistor 152, and a third current mirror PMOS transistor 154. Load 42 includes a load resistor 156.

The gate of first current mirror PMOS transistor 150 receives first bias voltage VFB at 46 and one side of the drain-source path of first current mirror PMOS transistor 150 is electrically coupled to VDD at 158. The other side of the drain-source path of first current mirror PMOS transistor 150 is electrically coupled at 160 to one side of the drain-source path of second current mirror PMOS transistor 152. The other side of the drain-source path of second current mirror PMOS transistor 152 is electrically coupled at 162 to one side of the drain-source path of third current mirror PMOS transistor 154. The other side of the drain-source path of third current mirror PMOS transistor 154 is electrically coupled to load resistor 156 via load path 52. The other side of load resistor 156 is electrically coupled to a reference, such as ground, at 164. The gate of second current mirror PMOS transistor 152 receives second bias voltage VSB at 50 and the gate of third current mirror PMOS transistor 154 receives a reference voltage, such as ground, at 166.

In operation, first current mirror PMOS transistor 100 is biased to conduct current via first bias voltage VFB at 48, second current mirror PMOS transistor 102 is biased to conduct current via second bias voltage VSB at 50, and third current mirror PMOS transistor 104 is biased to conduct current via the reference voltage at 126. The current mirror PMOS transistors 150, 152, and 154 provide mirrored reference current IM at 52, which has substantially the same, current value as reference current IRC at 48. Load resistor 156 receives mirrored reference current IM at 52.

Figure 5:
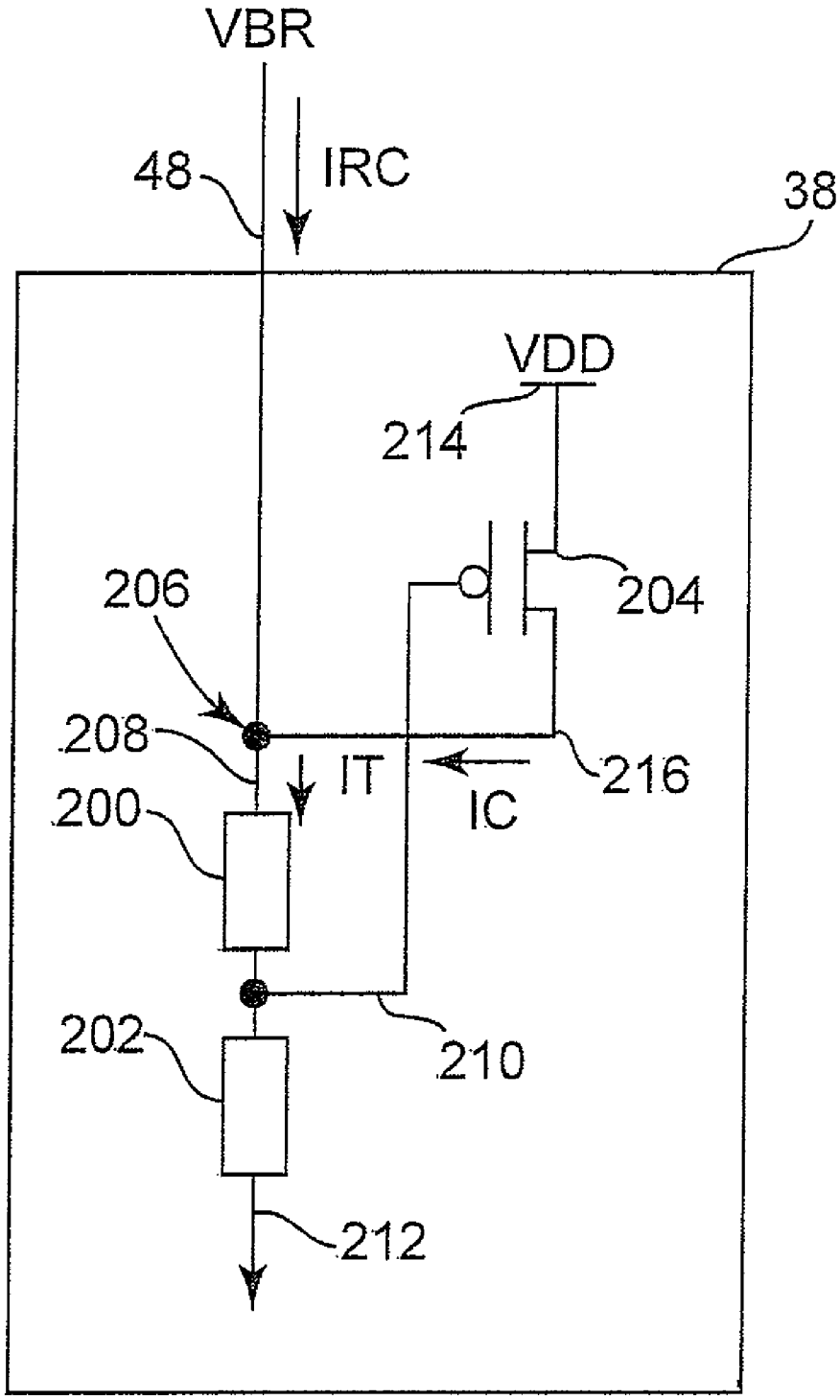
FIG. 5 is a diagram illustrating one embodiment of a compensation circuit.

FIG. 5 is a diagram illustrating one embodiment of compensation circuit 38. Compensation circuit 38 receives reference current IRC at 48 and provides buffered reference voltage. VBR at 48. Compensation circuit 38 includes a first resistor 200, a second resistor 202, and a PMOS compensation transistor 204.

One end of first resistor 200 is electrically coupled to node 206 via total current path 208. The other end of first resistor 200 is electrically coupled to one end of second resistor 202 and the gate of PMOS compensation transistor 204 via gate path 210. The other end of second resistor 202 is electrically coupled to a reference, such as ground, at 212. One end of the drain-source path of PMOS compensation transistor 204 is electrically coupled to VDD at 214. The other end of the drain-source path of PMOS compensation transistor 204 is electrically coupled to node 206 via compensation current-path 216.

Node 206 receives reference current IRC at 48 via bias circuit 36 and compensation current IC at 216 via PMOS compensation transistor 204. The currents are summed to provide a total current IT at 208. The total current IT at 208 includes reference current IRC at 48 and compensation current IC at 216.

First resistor 200 receives total current IT at 208, and second resistor 202 receives total current IC at 208 via first resistor 200. Buffered reference voltage VBR at 48 is the voltage across first resistor 200 and second resistor 202. Buffered reference voltage VBR at 48 is fed back to buffer 34 and compared to reference voltage VR at 44. Buffer 34 provides first bias voltage VFB at 46 to bias circuit 36 and bias circuit 36 provides reference current IRC at 48. Resistance values of first resistor 200 and second resistor 202 change based on variations in the process parameters and the magnitude of total current IT at 208 changes to maintain buffered reference voltage VBR at 48 substantially equal to reference voltage VR at 44.

If the resistance values decrease due to process variations, total current. IT at 208 increases. Also, PMOS compensation transistor 204 is biased to conduct more current and compensation current IC at 216 increases due to the process variations. If the resistance values increase due to process variations, total current IT at 208 decreases. Also, PMOS compensation transistor 204 is biased to, conduct less current and compensation current IC at 216 decreases due to the process variations. Compensation current IC at 216 compensates for changes in total current IT at 208, which limits changes in reference current IRC at 48. In one embodiment, first resistor 200 and second resistor 202 are polysilicon resistors.

In one embodiment, first resistor 200 and second resistor 202 are polysilicon resistors and the resistance values of first resistor 200 and second resistor 202 change substantially plus or minus 9% due to process variations. This results in a change in total current IT at 208 of substantially plus or minus 9% based on the changes in first resistor 200 and second resistor 202. Compensation current IC at 216 changes to compensate for the changes in total current IT at 208, and reference current IRC at 48 is limited to changes of substantially plus or minus 4%.

Figure 6A:
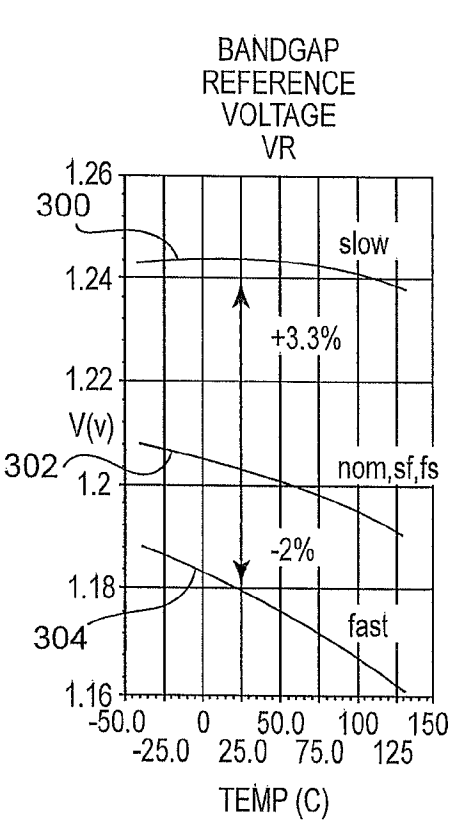
FIG. 6A is a graph illustrating a bandgap reference voltage.

FIG. 6A is a graph illustrating a bandgap reference voltage VR provided via one embodiment of voltage reference circuit 32 (shown in FIG. 2). The bandgap reference voltage VR is plotted in volts versus temperature in degrees Celsius. The different lines on the graph represent the bandgap reference voltage VR-provided at different process parameters.

At 300, the process parameters are slow, where both PMOS and NMOS transistors are slow. The bandgap reference voltage VR is substantially 1.24 volts and has a small parabolic arc over temperature.

At 302, the process parameters are either nominal, slow-fast, or fast slow. If the process parameters are nominal at 302, both transistor types of PMOS and NMOS are nominal. If the process parameters are slow-fast at 302, one of the transistor types is slow and the other is fast. If the process parameters are fast-slow at 302, the speeds switch and the one transistor type is fast and the other is slow. At 302, the bandgap reference voltage VR is substantially 1.2 volts and has a falling parabolic arc over temperature.

At 304, the process parameters are fast, where both PMOS and NMOS transistors are fast. The bandgap reference voltage VR is substantially 1.18 volts and has a falling parabolic arc over temperature.

The bandgap reference voltage VR at 300 is substantially 3.3% higher than the bandgap reference voltage VR at 302. The bandgap reference voltage VR at 304 is substantially 2.0% lower than the bandgap reference voltage VR at 302. Thus, the bandgap reference voltage VR changes plus or minus 2.65% or about plus or minus 2.5% over the variations in the process parameters.

Figure 6B:
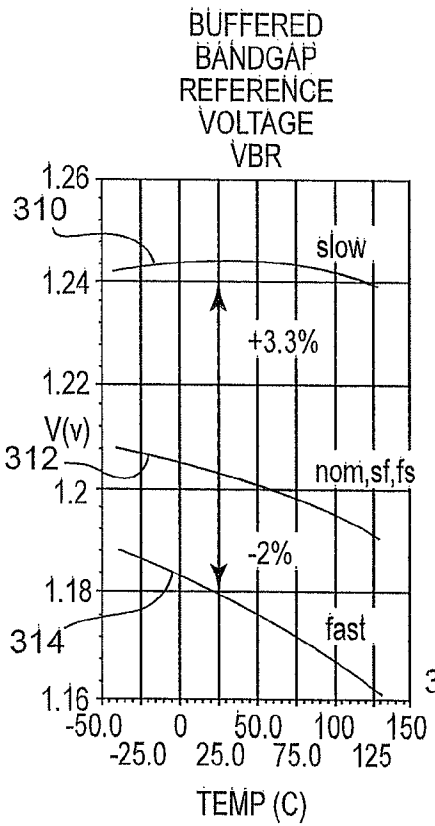
FIG. 6B is a graph illustrating a buffered bandgap reference voltage.

FIG. 6B is a graph illustrating the buffered bandgap reference voltage VBR (shown in FIG. 2). The buffered bandgap reference voltage VBR is plotted in volts versus temperature in degrees Celsius. The different lines on the graph represent the bandgap reference voltage VR provided at different process parameters.

At 310, the process parameters are slow, where both PMOS and NMOS transistors are slow. The buffered bandgap reference voltage VBR is substantially 1.24 volts and has a small parabolic arc over temperature.

At 319, the process parameters are either nominal, slow-fast, or fast-slow. If the process parameters are nominal at 312, both transistor types of PMOS and NMOS are nominal. If the process parameters are slow-fast at 312, one of the transistor types is slow and the other is fast. If the process parameters are fast-slow at 312, the speeds switch and the one-transistor type is fast and the other is slow. At 312, the buffered bandgap reference voltage VBR is substantially 1.2 volts and has a falling parabolic arc over temperature.

At 314, the process parameters are fast, where both PMOS and NMOS transistors are fast. The buffered bandgap reference voltage VBR is substantially 1.18 volts and has a falling parabolic arc over temperature.

The buffered bandgap reference voltage VBR at 310 is substantially 3.3 higher than the buffered bandgap reference voltage VBR at 312. The buffered bandgap reference voltage VBR at 314 is substantially 2.0% lower than the buffered bandgap reference voltage VBR at 312. Thus, the buffered bandgap reference voltage VBR changes plus or minus 2.65% or about plus or minus 2.5 over variations in the process parameters.

Figure 6C:
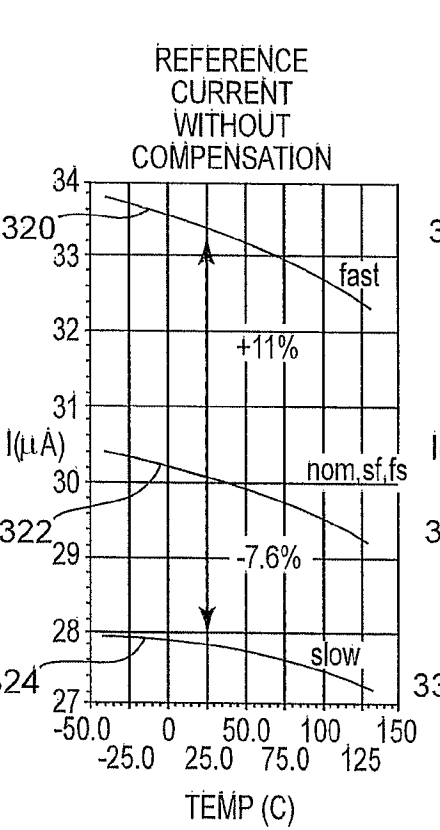
FIG. 6C is a graph illustrating a reference current without compensation.

FIG. 6C is a graph illustrating the reference current IRC where PMOS compensation transistor 204 has been removed from compensation circuit 38 of FIG. 5. The reference current without compensation is plotted in micro-amps versus temperature in degrees Celsius. The different lines on the graph represent the reference current without compensation that is provided at different process parameters.

At 320, the process parameters are fast, where both PMOS and NMOS transistors are fast. The reference current without compensation is substantially 33 micro-amps and has a falling parabolic arc over temperature.

At 322, the process parameters are either nominal, slow-fast, or fast-slow. If the process parameters are nominal at 322, both transistor types of PMOS and NMOS are nominal. If the process parameters are slow-fast at 322, one of the transistor types is slow and the other is fast. If the process parameters are fast-slow at 322, the speeds switch and the one transistor type is fast and the other is slow. At 322, the reference current without compensation is substantially 30 micro-amps and has a falling parabolic arc over temperature.

At 324, the process parameters are slow, where both PMOS and NMOS transistors are slow. The reference current without compensation is substantially 28 micro-amps and has a small parabolic arc over temperature.

The reference current without compensation at 320 is substantially 11.0 higher than the reference current without compensation at 322. The reference current without compensation at 324 is substantially 7.6% lower than the reference current without compensation at 322. Thus, the reference current without compensation changes plus or minus 9.3% or about plus or minus 9% over variations in the process parameters. The percentage change in the reference current without compensation due to process variations is more than three times the percentage change in bandgap reference voltage due to process variations.

Figure 6D:
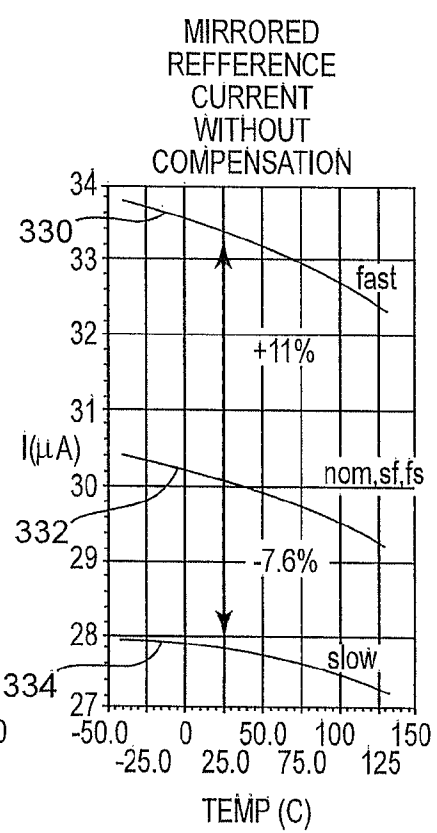
FIG. 6D is a graph illustrating a mirrored reference current without compensation.

FIG. 6D is a graph illustrating, the mirrored reference current IM where PMOS compensation transistor 204 has been removed from compensation circuit 38 of FIG. 5. The mirrored reference current without compensation is plotted in micro-amps versus temperature in degrees Celsius. The different lines on the graph represent the mirrored reference current without compensation that is provided at different process parameters.

At 330, the process parameters are fast, where both PMOS and NMOS transistors are fast. The mirrored reference current without compensation is substantially 33 micro-amps and has a falling parabolic arc over temperature.

At 332, the process parameters are either nominal, slow-fast, or fast-slow. If the process parameters are nominal at 332, both transistor-types of PMOS and NMOS are nominal. If the process parameters are slow-fast at 332, one of the transistor types is slow and the other is fast. If the process parameters are fast-slow at 332, the speeds switch and the one transistor type is fast and the other is slow. At 332, the mirrored reference current without compensation is substantially 30 micro-amps and has a falling parabolic arc over temperature.

At 334, the process parameters are slow, where both PMOS and NMOS transistors are slow. The mirrored reference current without compensation is substantially 28 micro-amps and has a small parabolic arc over temperature.

The mirrored reference current without compensation at 330 is substantially 11.0% higher than the mirrored reference current without compensation at 332. The mirrored reference current without compensation at 334 is substantially 7.6% lower than the mirrored reference current without compensation at 332. Thus, the mirrored reference current without compensation changes plus or minus 9.3% or about plus or minus 9% over variations in the process parameters. The percentage change in the mirrored reference current without compensation due to process variations is more than three times the percentage change in bandgap reference voltage due to process variations.

Figure 7:
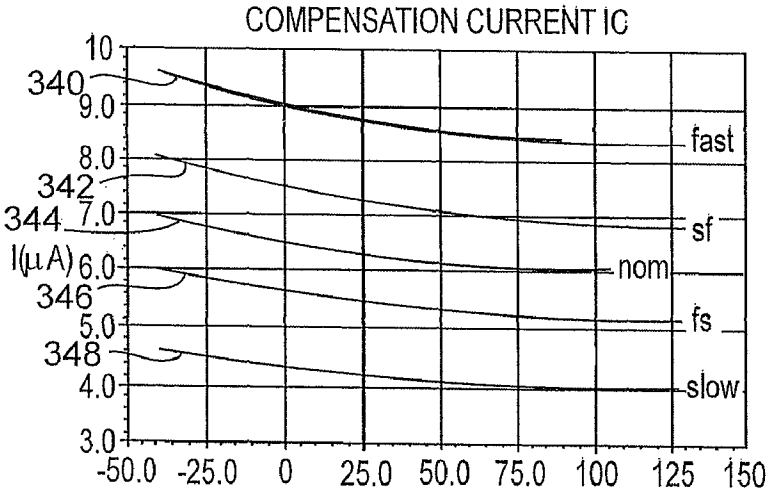
FIG. 7 is a graph illustrating compensation current in one embodiment of a compensation circuit.

FIG. 7 is a graph illustrating the compensation current IC in one embodiment of a compensation-circuit 38 that includes PMOS compensation transistor 204. The compensation current IC is plotted in micro-amps versus temperature in degrees Celsius. The different lines on the graph represent the compensation-current IC provided with different process parameters.

At 340, the process parameters are fast, where both PMOS and NMOS transistors are fast. The compensation current IC is highest when the process parameters are fast and the high compensation current IC provides some of the high total current IT, which is similar to the reference current without compensation at 320 in FIG. 6C. The high compensation current reduces the change in reference current IRC. The compensation current IC is substantially in a range between 8 and 10 micro-amps, decreasing over temperature.

At 342, the process parameters are slow-fast, where one of the transistor types of PMOS and NMOS is slow and the other is fast. The compensation current IC is substantially in a range between 7 and 8 micro-amps, decreasing over temperature.

At 344, the process parameters are nominal, where both transistor types of PMOS and NMOS are nominal. The compensation current IC is substantially in a range between 6 and 7 micro-amps, decreasing over temperature.

At 346, the process parameters are fast-slow, where one of the transistor types is fast and the other is slow. The compensation current IC is substantially in a range between 5 and 6 micro-amps, decreasing over temperature.

At 348, the process parameters are slow, where both PMOS and NMOS transistors are slow. The compensation current IC is lowest when the process parameters are slow and the lower compensation current IC provides some of the decrease in total current IT, which is similar to the reference current without compensation at 324 in FIG. 6C. The lower compensation current reduces the change in reference current IRC. The compensation current IC is substantially in a range between 4 and 5 micro-amps, decreasing over temperature.

Figure 8B:
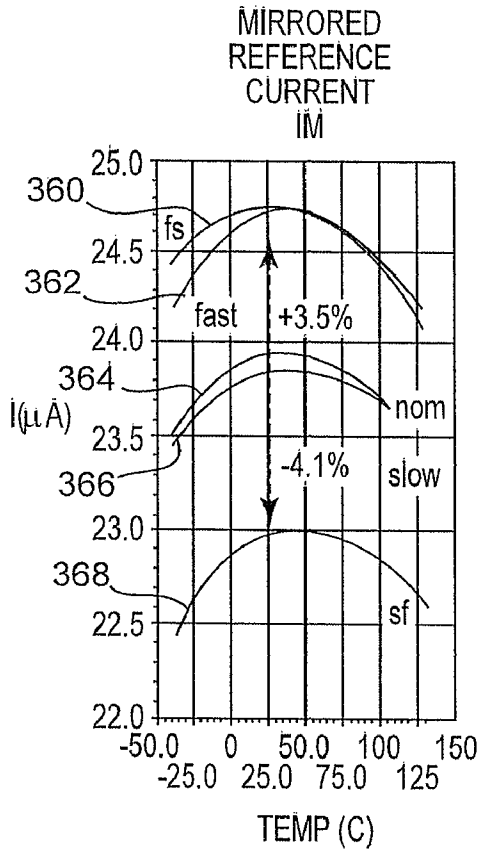
FIG. 8B is a graph illustrating a mirrored reference current with compensation.
Figure 8A:
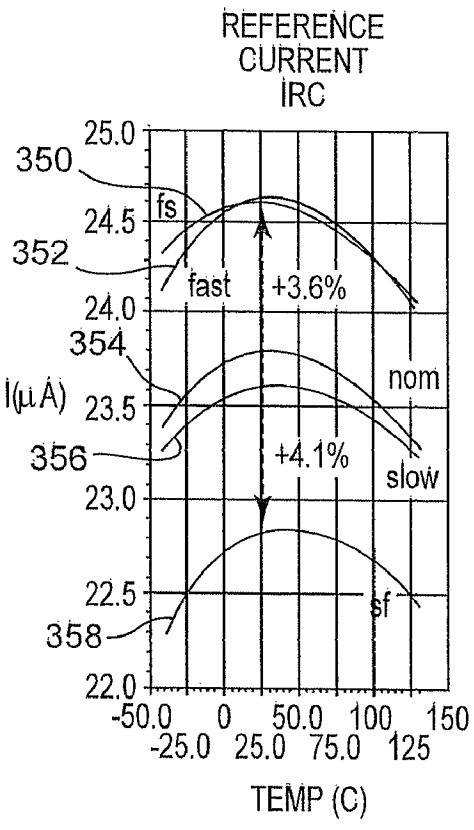
FIG. 8A is a graph illustrating reference current with compensation.

FIG. 8A is a graph illustrating the reference current IRC, where compensation circuit 38 includes PMOS compensation transistor 204. The reference current IRC with compensation is plotted in micro-amps versus temperature in degrees Celsius. The different lines on the graph represent the reference current IRC provided with different process parameters.

At 350, the process parameters are fast-slow, where one of the transistor types is fast and the other is slow. The reference current IRC is provided in a parabolic arc at substantially 24.5 micro-amps.

At 352, the process parameters are fast, where both PMOS and NMOS transistors are fast. The reference current IRC is high when the process parameters are fast, but the reference current IRC is moderated via the high compensation current IC at 340 of FIG. 7. The reference current IRC is provided in a parabolic arc at substantially 24.5 micro-amps.

At 354, the process parameters are nominal, where both transistor types of PMOS and NMOS are nominal. The reference current IRC is provided in a parabolic arc slightly above 23.5 micro-amps.

At 356, the process parameters are slow, where both PMOS and NMOS transistors are slow. The reference current IRC without compensation at 324 is lower when the process parameters are slow, but the reference current IRC with compensation is moderated via the lower compensation current IC at 348 of FIG. 7. The reference current IRC is provided in a parabolic arc at substantially 23.5 micro-amps.

At 358, the process parameters are slow-fast, where one of the transistor types of PMOS and NMOS is slow and the other is fast. The reference current IRC is provided in a parabolic arc at substantially 22.5 micro-amps.

The reference current IRC at 350 and 352 is substantially 3.6% higher than the reference current IRC at 354 and 356. The reference current IRC at 358 is substantially 4.1% lower than the reference current IRC at 354 and 356. Thus, the reference current IRC changes plus or minus 3.85% or about plus or minus 4% over variations in the process parameters. The percentage change in the reference current IRC due to process variations is less than two times the percentage change in bandgap reference voltage due to process variations.

FIG. 8B is a graph illustrating the mirrored reference current IM, where compensation circuit 38 includes PMOS compensation transistor 204. The mirrored reference current IM with compensation is plotted in micro-amps versus temperature in degrees Celsius. The different lines on the graph represents the mirrored reference current IM provided with different process parameters.

At 360, the process parameters are fast-slow, where one of the transistor types is fast and the other is slow. The mirrored reference current IM is provided in a parabolic arc at substantially 24.5 micro-amps.

At 362, the process parameters are fast, where both PMOS and NMOS transistors are fast. The mirrored reference current IM is provided in a parabolic arc at substantially 24.5 micro-amps.

At 364, the process parameters are nominal, where both transistor types of PMOS and NMOS are nominal. The mirrored reference current IM is provided in a parabolic arc slightly above 23.5 micro-amps.

At 366, the process parameters are slow, where both PMOS and NMOS transistors are slow. The mirrored reference current IM is provided in a parabolic arc slightly above 23.5 micro-amps.

At 368, the process parameters are slow-fast, where one of the transistor types of PMOS and NMOS is slow and the other is fast. The mirrored reference current IM is provided in a parabolic arc substantially between 22.5 and 23.0 micro-amps.

The mirrored reference current IM at 360 and 362 is substantially 3.5% higher than the mirrored reference current IM at 364 and 366. The mirrored reference current IM at 368 is substantially 4.1% lower than the mirrored reference current IM at 364 and 366. Thus, the mirrored reference current IM changes plus or minus 3.8% or about plus or minus 4% over variations in the process parameters. The percentage change in the mirrored reference current IM due to process variations is less than two times the percentage change in bandgap reference voltage due to process variations.

Figure 9B:
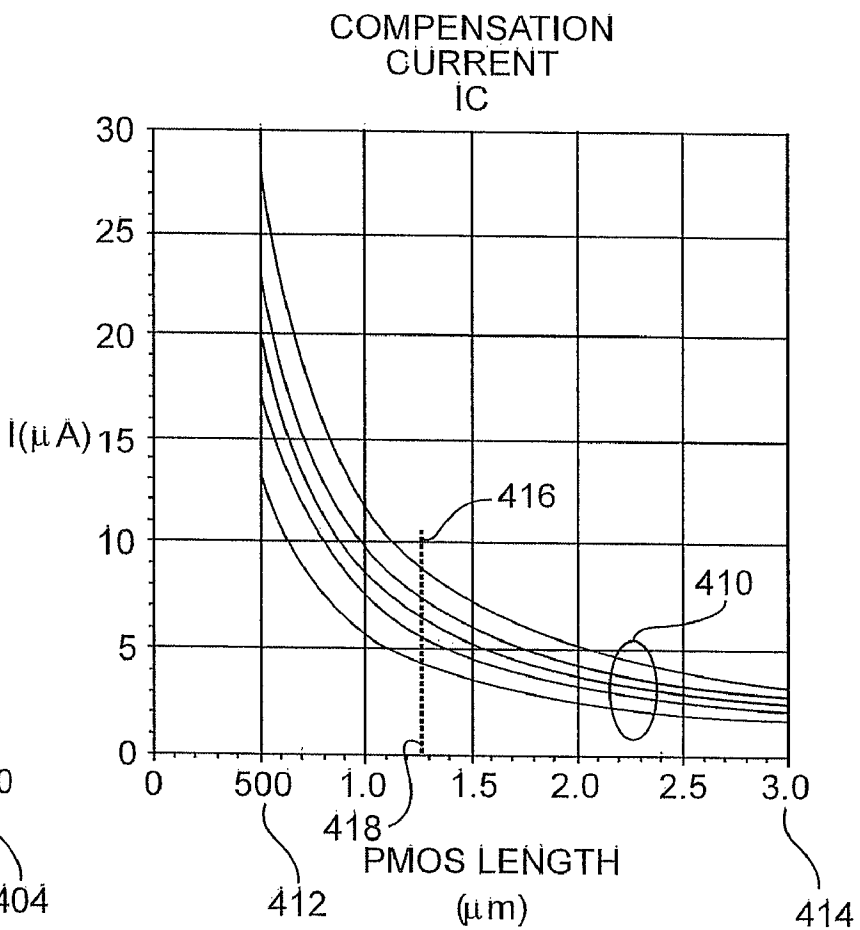
FIG. 9B is a graph illustrating compensation current over different channel lengths of a PMOS compensation transistor.
Figure 9A:
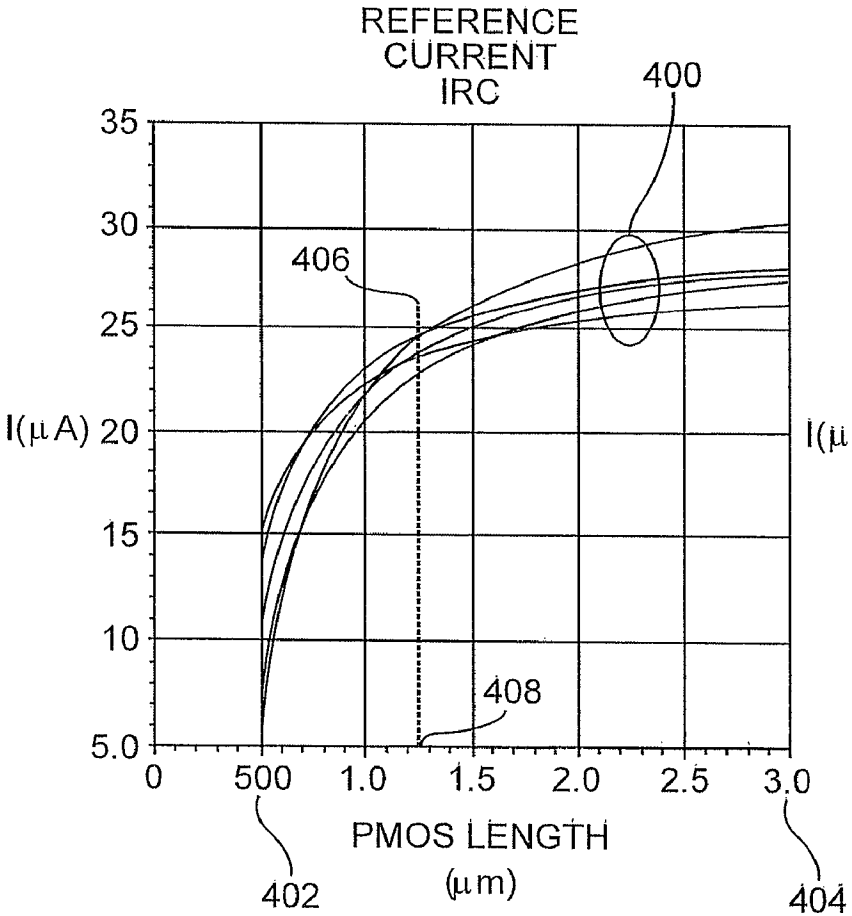
FIG. 9A is graph illustrating compensated reference current over different channel lengths of a PMOS compensation transistor.

FIG. 9A is a graph illustrating the compensated reference current IRC over different channel lengths of PMOS compensation transistor 204. The compensated reference current. IRC is plotted in micro-amps versus PMOS channel length in micrometers. Each of the five different lines at 400 on the graph represents the reference current IRC at one of the five different process parameter settings of fast, fast-slow, nominal, slow-fast, and slow. Temperature is held constant.

From the graph, an optimal channel length for the PMOS compensation transistor 204 can be chosen, where the optimal channel length provides the smallest variation in the reference current IRC over the five different process parameter settings. The channel width of PMOS compensation transistor 204 is held constant at 1 micrometer and the channel length is varied from 0.5 micrometers at 402 to 3.0 micrometers at 404. The variation in the reference current IRC over the five different process parameter settings is a minimum at 406 and the optimal channel length is 1.25 micrometers at 408.

FIG. 9B is a graph illustrating the compensation current IC over the different channel lengths of PMOS compensation transistor 204. The compensation current IC is plotted in micro-amps versus PMOS channel length in micrometers. Each of the five different lines at 410 on the graph represents the compensation current IC at one of the five different process parameter settings of fast, fast-slow, nominal, slow-fast, and slow. Temperature is held constant.

The channel width of PMOS compensation transistor 204 is held constant at 1 micrometer and the channel length is varied from 0.5 micrometers at 412 to 3.0 micrometers at 414. Each of the five different lines at 410 changes from a high value at 5 micrometers to a low value at 3.0 micrometers. The variation in the reference current IRC over the five different process parameter settings is a minimum at the optimal channel length of 1.25 micrometers at 418 and the compensation currents IC at 416.

Figures 10A, 10B, 10C, 10D:
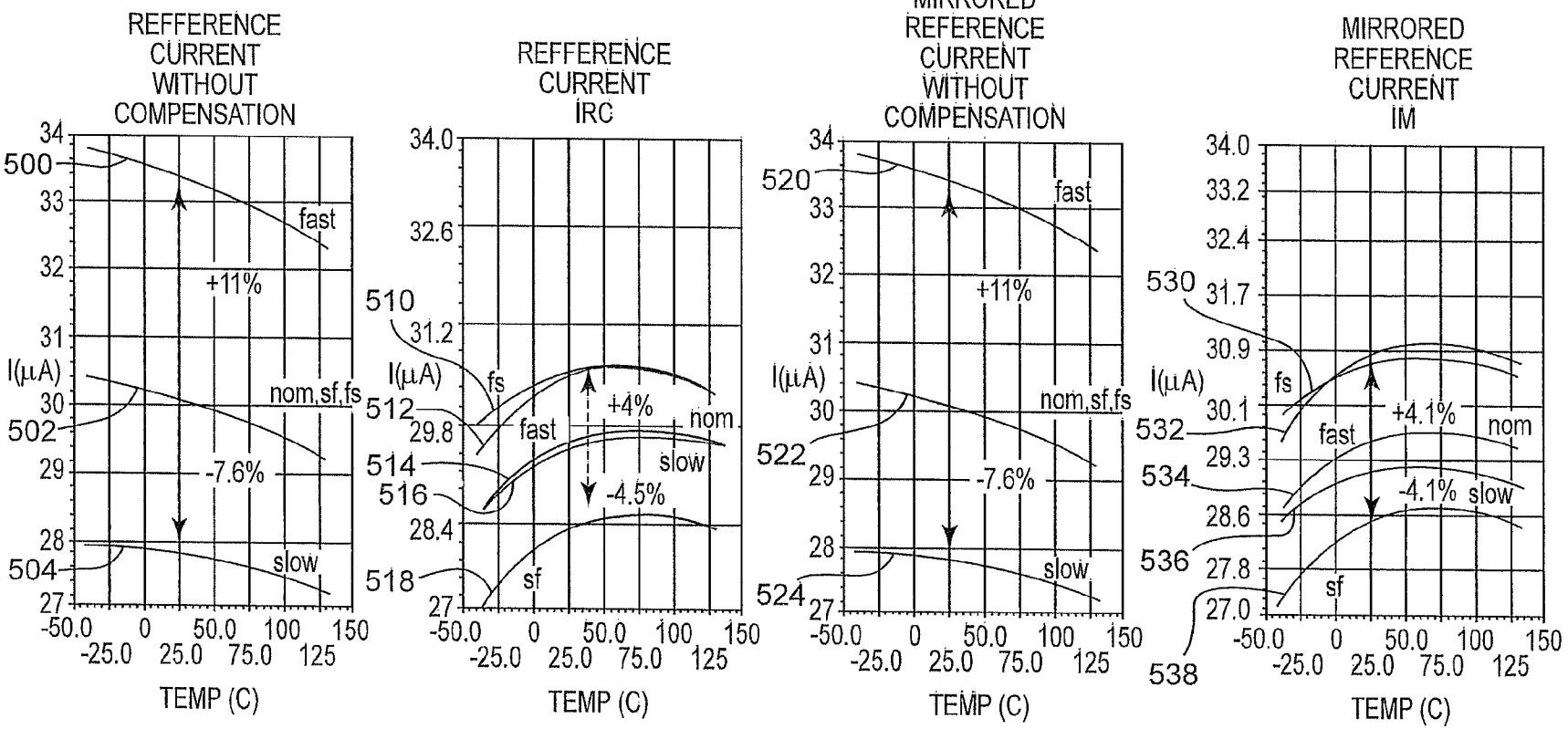
FIG. 10A is a graph illustrating reference current without compensation.
FIG. 10B is a graph illustrating compensated reference current at substantially 30 micro-amps.
FIG. 10C is a graph illustrating mirrored reference current without compensation.
FIG. 10D is a graph illustrating mirrored reference current with compensation adjusted to substantially 30 micro-amps.

FIG. 10A is a graph illustrating the reference current IRC, where PMOS compensation transistor 204 has been removed from compensation circuit 38 of FIG. 5. The reference current without compensation is plotted in micro-amps versus temperature in degrees Celsius. The different lines on the graph represent the reference current without compensation provided at different process parameters. The graph of FIG. 10A is similar to the graph, of FIG. 6C.

At 500, the process parameters are fast, where both PMOS and NMOS transistors are fast. The reference current without compensation is substantially; 33 micro-amps and has a falling parabolic arc over temperature.

At 502, the process parameters are either nominal, slow-fast, or fast-slow. If the process parameters are nominal at 502, both transistor types of PMOS and NMOS are nominal. If the process parameters are slow-fast at 502, one of the transistor types is slow and the other is fast. If the process parameters are fast-slow at 502, the speeds switch and the one transistor type is fast and the other is slow. At 502, the reference current without compensation is substantially 30 micro-amps and has a falling parabolic arc over temperature.

At 504, the process parameters are slow, where both PMOS and NMOS transistors are slow. The reference current without compensation is substantially between 27 and 28 micro-amps and has a small parabolic arc over-temperature.

The reference current without compensation at 500 is substantially 11.0 higher than the reference current without compensation at 502. The reference current without compensation at 504 is substantially 7.6% lower than the reference current without compensation at 502. Thus, the reference current without compensation changes plus or minus 9.3% or about plus or minus 9% over variations in the process parameters. The percentage change in the reference current without compensation due to process variations is more than three times the percentage change in bandgap reference voltage due to process variations.

FIG. 10B is a graph illustrating the reference current IRC, where compensation circuit 38 includes PMOS compensation transistor 204. First resistor 200, second resistor 202, and PMOS compensation transistor 204 have been adjusted to provide substantially 30 micro-amps in the reference current IRC and to minimize variations in the reference current IRC over the various process parameter settings. First resistor 200 has a resistance value of 25 kilo-ohms, second resistor 202 has a resistance value: of 6 kilo-ohms, the channel length of PMOS compensation transistor 204 is 1.2 micrometers, and the channel width is 1.0 micrometers. The compensated reference current IRC is plotted in micro-amps versus temperature in degrees Celsius. The different lines on the graph represent the reference current IRC provided with different process parameters.

At 510, the process parameters are fast-slow, where one of the transistor types is fast and the other is slow. The reference current IRC is provided in a parabolic arc between 29.8 and 31.2 micro-amps.

At 512, the process parameters are fast, where both PMOS and NMOS transistors are fast. The reference current without compensation is high at 500 when the process parameters are fast, but the reference current IRC is moderated via a high compensation current IC, such as the high compensation current IC at 340 of FIG. 7. The reference current IRC is provided in a parabolic arc substantially between 29.8 and 31.2 micro-amps.

At 514, the process parameters are nominal, where both transistor types of PMOS and NMOS are nominal. The reference current IRC is provided in a parabolic arc substantially between 28.4 and 29.8 micro-amps.

At 516, the process parameters are slow, where both PMOS and NMOS transistors are slow. The reference current without compensation at 504 is lower when the process parameters are slow, but the reference current IRC with compensation is moderated via a lower compensation current IC, such as lower compensation current IC at 348 of FIG. 7. The reference current IRC is provided in a parabolic arc substantially between 28.4 and 29.8 micro-amps.

At 518, the process parameters are slow-fast, where one of the transistor types of PMOS and NMOS is slow and the other is fast. The reference current IRC is provided in a parabolic arc substantially between 27.0 and 28.4 micro-amps.

The reference current IRC at 510 and 512 is substantially 4.0% higher than the reference current IRC at 514 and 516. The reference current IRC at 518 is substantially 4.5% lower than the reference current IRC at 514 and 516. Thus, the references current IRC changes plus or minus 4.25% or about plus or minus 4% over variations in the process parameters. The percentage change in the reference current IRC due to process variations is less than two times the percentage change in bandgap reference voltage due to process variations.

FIG. 10C is a graph illustrating the mirrored reference current IM, where PMOS compensation transistor 204 has been removed from compensation circuit 38 of FIG. 5. The mirrored reference current without compensation is plotted in micro-amps versus temperature in degrees Celsius. The different lines on the graph represent the mirrored reference current without compensation provided at different process parameters. The graph of FIG. 10C is similar to the graph of FIG. 6D.

At 520, the process parameters are fast, where both PMOS and NMOS transistors are fast. The mirrored reference current without compensation is substantially 33 micro-amps and has a falling parabolic arc over-temperature.

At 522, the process parameters are either nominal, slow-fast, or fast-slow. If the process parameters are nominal at 522, both transistor types of PMOS and NMOS are nominal. If the process parameters are slow-fast at 522, one of the transistor types is slow and the other is fast. If the process parameters are fast-slow at 522, the speeds switch and the one transistor type is fast and the other is slow. At 1522, the mirrored reference current without compensation is substantially 30 micro-amps and has a falling parabolic arc over temperature.

At 524, the process parameters are slow, where both PMOS and NMOS transistors are slow. The mirrored reference current without compensation is substantially between 27 and 28 micro-amps and has a small parabolic arc over temperature.

The mirrored reference current without compensation at 520 is substantially 11.0% higher than the mirrored reference current without compensation at 522. The mirrored reference current without compensation at 524 is substantially 7.6% lower than the mirrored reference current without compensation at 522. Thus, the mirrored reference current without compensation changes plus or minus 9.3% or about plus or minus 9% over variations in the process parameters.

FIG. 10D, is a graph illustrating the mirrored-reference current IM, where compensation circuit 38 includes PMOS compensation transistor 204. First resistor 200, second resistor 202, and PMOS compensation transistor 204 have been adjusted to provide substantially 30 micro-amps in the mirrored reference current IM and to minimize variations in the mirrored reference current IM over the various process parameter settings. First resistor 200 has a resistance value of 25 kilo-ohms, second resistor 202 has a resistance value of 6 kilo-ohms, the channel length of PMOS compensation transistor 204 is 1.2 micrometers, and the channel width is 1.0 micrometers. The mirrored reference current IM is plotted in micro-amps versus temperature in degrees Celsius. The different lines on the graph represent the mirrored reference current IM provided with different process parameters.

At 530, the process parameters are fast-slow, where one of the transistor types is fast and the other is slow. The mirrored reference current IM is provided in a parabolic arc substantially between 30.1 and 30.9 micro-amps.

At 532, the process parameters are fast, where both PMOS and NMOS transistors are fast. The mirrored reference current IM is provided in a parabolic arc substantially between 29.3 and 31.7 micro-amps.

At 534, the process parameters are nominal, where both transistor types of PMOS and NMOS are nominal. The mirrored reference current IM is provided in a parabolic arc substantially between 29.6 and 30.1-micro-amps.

At 536, the process parameters are slow, where both PMOS and NMOS transistors are slow. The mirrored reference current IM is provided in a parabolic arc substantially between 28.6 and 29.3 micro-amps.

At 538, the process parameters are slow-fast, where one of the transistor types of PMOS and NMOS is slow and the other is fast. The mirrored reference current IM is provided in a parabolic arc substantially between 27.0 and 28.6 micro-amps.

The mirrored reference current IM at 530 and 532 is substantially 4.1% higher than the mirrored reference current IM at 534 and 536. The mirrored reference current IM at 538 is substantially 4.1% lower than the mirrored reference current IM at 534 and 536. Thus, the mirrored reference current IM changes plus or minus 4.1% or about plus or minus 4% over variations in the process parameters.

Compensation circuit 38 includes compensation transistor 204 that provides compensation current IC. Compensation current IC is higher or lower based on process variations. Also, first resistor 200 and second resistor 202 are lower or higher based on process variations. Compensation current IC compensates for changes in first resistor 200 and second resistor 202 to limit changes in reference current IRC.

In one embodiment, resistors 200 and 202 are polysilicon resistors and the resistance values of resistors 200 and 202 change substantially plus or minus 9% due to process variations. This results in a total current IT change of substantially plus or minus 9%. The compensation current IC changes to compensate for the changes in the total current IT, and the reference current IRC is limited to changes of substantially plus or minus 4%.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A semiconductor device comprising:

a first resistor;

a second resistor directly coupled to the first resistor at a node and configured to receive a current via the first resistor; and a transistor configured to be driven via the first resistor and the second resistor and provide a compensation current, wherein a gate input of the transistor is directly coupled to the node to bias the transistor to provide more or less of the compensation current, and the current includes the compensation current and a reference current and changes in the current are compensated for via the compensation current, which limits changes in the reference current.

2. The semiconductor device of claim 1, comprising:

a first circuit configured to receive a reference voltage and a buffered reference voltage, wherein the buffered reference voltage is regulated to substantially the same voltage level as the reference voltage and the first resistor receives the buffered reference voltage.

3. The semiconductor device of claim 2, comprising:

a second circuit configured to provide the reference voltage.

4. The semiconductor device of claim 3, wherein the second circuit is a bandgap voltage circuit and the reference voltage is a temperature stabilized bandgap voltage.

5. The semiconductor device of claim 2, wherein the first circuit comprises:

an operational amplifier configured to receive the reference voltage and the buffered reference voltage; and a bias circuit configured to be driven via the operational amplifier and provide the reference current.

6. The semiconductor device of claim 1, wherein each of the first resistor and the second resistor is a polysilicon resistor.

7. The semiconductor device of claim 1, wherein values of the first resistor and the second resistor are limited to a range of plus and minus nine percent and the reference current is limited to a range of plus and minus four percent.

8. The semiconductor device of claim 1, comprising a first circuit configured to mirror the reference current and provide a mirrored reference current.

9. An integrated circuit comprising:

a bandgap circuit configured to provide a bandgap voltage;

a first circuit configured to receive the bandgap voltage and a buffered bandgap voltage and provide a reference current;

a first resistor configured to receive a current;

a second resistor directly coupled to the first resistor at a node and configured to receive the current via the first resistor; and a transistor configured to be driven via the first resistor and the second resistor and provide a compensation current, wherein a gate input of the transistor is directly coupled to the node to bias the transistor to provide more or less of the compensation current, and the current includes the reference current and the compensation current and the first resistor and the second resistor receive the current and provide the buffered bandgap voltage.

10. The integrated circuit of claim 9, wherein changes in the current based on variations in the first resistor and the second resistor are compensated for via the compensation current, which limits changes in the reference current.

11. The integrated circuit of claim 10, wherein variations in the first resistor and the second resistor are limited to a range of substantially plus and minus nine percent and the reference current is limited to a range of substantially plus and minus four percent.

12. The integrated circuit of claim 9, comprising a second circuit configured to mirror the reference current and provide a mirrored reference current.

13. The integrated circuit of claim 9, wherein the buffered bandgap voltage is regulated to substantially the same voltage level as the bandgap voltage.

14. The integrated circuit of claim 9, wherein the first circuit comprises:

an operational amplifier configured to receive the bandgap voltage and the buffered bandgap voltage; and a bias circuit configured to be driven via the operational amplifier and provide the reference current.

15. A method of providing a reference current comprising:

receiving a current that includes the reference current at a first resistance;

receiving the current at a second resistance that is directly coupled to the first resistance at a node and receives the current via the first resistance; and driving a transistor having a gate input via the gate input that is directly coupled to the node to bias the transistor to provide more or less of a compensation current in the current, which compensates for changes in the current and limits changes in the reference current.

16. The method of claim 15, comprising:

limiting the reference current to a range of substantially plus and minus four percent.

17. The method of claim 15, comprising:

receiving a reference voltage;

receiving a buffered reference voltage; and driving a bias circuit based on the reference voltage and the buffered reference voltage to provide the reference current.

18. The method of claim 17, comprising:

providing the buffered reference voltage via the first resistance and the second resistance.

19. The method of claim 17, comprising:

providing a temperature stabilized bandgap voltage as the reference voltage.

20. The method of claim 15, comprising:

mirroring the reference current to provide a mirrored reference current.

21. A method of limiting changes in a reference current comprising:

conducting a current that includes the reference current via a first resistor;

conducting the current via a second resistor that is directly coupled to the first resistor at a node and receives the current via the first resistor; and driving a transistor having a gate input by the gate input that is directly coupled to the node to bias the transistor to provide more or less of a compensation current in the current, where the compensation current compensates for changes in the current and limits changes in the reference current.

22. The method of claim 21, comprising:

receiving a bandgap voltage;

receiving a buffered reference voltage that is provided across the first resistor and the second resistor; and driving a bias circuit that provides the reference current based on the bandgap voltage and the buffered reference voltage.

23. The method of claim 22, comprising:

regulating the buffered reference voltage to substantially the same voltage level as the bandgap voltage.

24. The method of claim 21, comprising:

mirroring the reference current to provide a mirrored reference current.

25. A semiconductor device comprising:

a first resistor;

a second resistor configured to receive a current via the first resistor;

a transistor configured to be driven via the first resistor and the second resistor and provide a compensation current, wherein the current includes the compensation current and a reference current and changes in the current are compensated for via the compensation current, which limits changes in the reference current;

a first circuit configured to receive a reference voltage and a buffered reference voltage, wherein the buffered reference voltage is regulated to substantially the same voltage level as the reference voltage and the first resistor receives the buffered reference voltage; and a second circuit configured to provide the reference voltage, wherein the second circuit is a bandgap voltage circuit and the reference voltage is a temperature stabilized bandgap voltage.

* * * * *